US008571455B2

(12) United States Patent
Yamada

(10) Patent No.: US 8,571,455 B2
(45) Date of Patent: Oct. 29, 2013

(54) FIXING DEVICE AND IMAGE FORMING APPARATUS INCLUDING SAME HAVING A SEPARATION PLATE ASSEMBLY

(75) Inventor: Masamichi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 159 days.

(21) Appl. No.: 13/238,235

(22) Filed: Sep. 21, 2011

(65) Prior Publication Data

US 2012/0082491 A1 Apr. 5, 2012

(30) Foreign Application Priority Data

Oct. 4, 2010 (JP) ..... 2010-224543

(51) Int. Cl.
*G03G 15/20* (2006.01)

(52) U.S. Cl.
USPC ..... 399/323

(58) Field of Classification Search
USPC ..... 399/323, 406
See application file for complete search history.

(56) References Cited

U.S. PATENT DOCUMENTS

| | | | | |
|---|---|---|---|---|
| 4,475,804 | A * | 10/1984 | Kanno et al. | 399/323 |
| 6,088,558 | A | 7/2000 | Yamada et al. | |
| 6,091,926 | A | 7/2000 | Yamada | |
| 6,351,619 | B1 | 2/2002 | Yamada | |
| 6,553,204 | B1 | 4/2003 | Yamada | |
| 6,577,840 | B2 | 6/2003 | Hachisuka et al. | |
| 6,865,363 | B2 | 3/2005 | Hachisuka et al. | |
| 6,925,280 | B2 | 8/2005 | Yamada | |
| 7,228,096 | B2 | 6/2007 | Yamada | |
| 7,359,664 | B2 | 4/2008 | Yamada | |
| 7,751,768 | B2 | 7/2010 | Yamada | |
| 7,890,039 | B2 | 2/2011 | Yamada | |
| 2010/0189477 | A1 | 7/2010 | Yamada | |
| 2010/0226700 | A1 | 9/2010 | Yamada et al. | |
| 2010/0303523 | A1 | 12/2010 | Yamada | |
| 2011/0222874 | A1 | 9/2011 | Yamada | |
| 2011/0222881 | A1 | 9/2011 | Yamada | |
| 2011/0229201 | A1 | 9/2011 | Yamada | |

FOREIGN PATENT DOCUMENTS

| | | |
|---|---|---|
| JP | 2005-37567 | 2/2005 |
| JP | 2008-65042 | 3/2008 |

* cited by examiner

*Primary Examiner* — Susan Lee
(74) *Attorney, Agent, or Firm* — Oblon, Spivak, McClelland, Maier & Neustadt, L.L.P.

(57) ABSTRACT

A fixing device includes two rollers to form a fixing nip and a separation plate assembly disposed near one of the rollers. The separation plate assembly includes at least one separation plate to separate a recording medium from the roller, a pair of contact members, a holding member having a rotation shaft at each end in a longitudinal direction thereof, to hold at least one separation plate and the contact members in a rotation axis direction, and a contact pressure adjuster to adjust a contact pressure of the contact members relative to the roller by bending a portion of the holding member holding one of the pair of contact members to the roller and to the opposite of the roller. When the holding member is rotated about the rotation shafts, the contact members contact the roller to separate at least one separation plate from the roller.

9 Claims, 10 Drawing Sheets

FIXING DEVICE AND IMAGE FORMING APPARATUS INCLUDING SAME HAVING A SEPARATION PLATE ASSEMBLY

CROSS-REFERENCE TO RELATED APPLICATIONS

This patent application is based on and claims priority pursuant to 35 U.S.C. §119 to Japanese Patent Application No. 2010-224543, filed on Oct. 4, 2010, in the Japan Patent Office, the entire disclosure of which is hereby incorporated herein by reference.

BACKGROUND OF THE INVENTION

1. Field of the Invention

Exemplary aspects of the present invention generally relate to a fixing device and an image forming apparatus such as a copier, a facsimile machine, a printer, or a multi-functional system including a combination thereof including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

The fixing device used in such image forming apparatuses may include a pair of looped belts or rollers, one being heated by a heater for melting toner (hereinafter referred to as "fixing member") and the other being pressed against the fixing member (hereinafter referred to as "pressing member"). In a fixing process, the fixing member and the pressing member meet and press against each other, forming a so-called fixing nip through which a recording medium passes to fix a toner image thereon under heat and pressure.

Toner used in such fixing devices generally contains resin material. When melted in the fixing nip, the toner in the toner image on the recording medium tends to stick to the fixing member, winding around the fixing member even after the recording medium exits the fixing nip, causing a paper jam. To address such difficulty, a wax component is added to the toner, or alternatively, the fixing member is covered with a release agent such as silicone oil, to prevent the toner in the toner image sticking to the fixing member.

To facilitate separation of the recording medium bearing the melted toner from the fixing member, a separation mechanism including a separation claw is provided to separate physically the recording medium undesirably wound around the fixing member from the fixing member.

However, there is a drawback to this configuration in that the separation claw of the separation mechanism contacts slidably the fixing member, and thus toner accumulates easily at a portion where the separation claw and the fixing member meet. When the accumulated toner reaches a certain amount, the toner separates from the contact portion, thereby contaminating the recording medium. Furthermore, such a separation claw slidably contacts the fixing member while rotating, leaving a trace of slide on the surface of the fixing member, thereby yielding a resulting image with streaks.

In recent years, however, because of difficulty in handling of the release agent such as the silicone oil, application of such a release agent on the surface of the member becomes less frequent, complicating efforts to separate reliably the recording medium bearing the toner image from the fixing member.

To counteract such difficulty, a contactless separation plate disposed very close to the fixing member is proposed.

In order to obtain similar reliable separation ability as the separation claw that directly contacts the fixing member, the space between the contactless separation plate and the fixing member needs to be minute and adjusted by 0.1 mm, for example. Furthermore, the separation plate needs to be disposed as close to the nip exit as possible.

For example, a known approach includes a separation guide provided with a curved member (contact members) at both ends of the separation guide in an axial direction. The separation guide is disposed at the nip exit. A certain amount of the space between the separation guide and the fixing member is maintained by the curved members that contact both ends of the fixing member in the axial direction thereof outside a maximum image area where the recording medium of a maximum size will not pass.

Although advantageous and generally effective for its intended purpose, there is a drawback to this configuration that the separation guide is made of molded heat resistant resin and deforms due to twist against the axial direction, complicating efforts to maintain the gap of 0.1 to 0.6 mm between the separation guide and the fixing member along the axial direction.

Such deformation of the separation guide in the direction of twist relative to the axial direction causes a difference in a contact pressure of the curved member (contact members) at each end contacting the rotating fixing member. Consequently, the curved member having the higher contact pressure against the fixing member damages the fixing member.

BRIEF SUMMARY OF THE INVENTION

In view of the foregoing, in one illustrative embodiment of the present invention, a fixing device includes two rollers to meet and press against each other to form a fixing nip and a separation plate assembly. The separation plate assembly is disposed near one of the rollers and includes at least one separation plate to separate a recording medium exiting the fixing nip from the roller, a pair of contact members disposed outside a maximum image area, a holding member having a rotation shaft at each end in a longitudinal direction thereof, to hold at least one separation plate and the pair of contact members along an axial direction of the rotation shafts parallel to a rotation shaft of the roller, and a contact pressure adjuster to adjust a contact pressure of the pair of contact members relative to the roller by bending a portion of the holding member holding one of the pair of contact members to the roller and to the opposite of the roller. When the holding member is rotated about the rotation shafts, the pair of contact members contacts the roller to separate the tip of at least one separation plate from the roller.

Additional features and advantages of the present invention will be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein:

FIGS. 6 (*b*) and 6 (*c*) are partially enlarged perspective views of a contact member of the separation plate assembly;

DETAILED DESCRIPTION OF THE INVENTION

Figure 1:
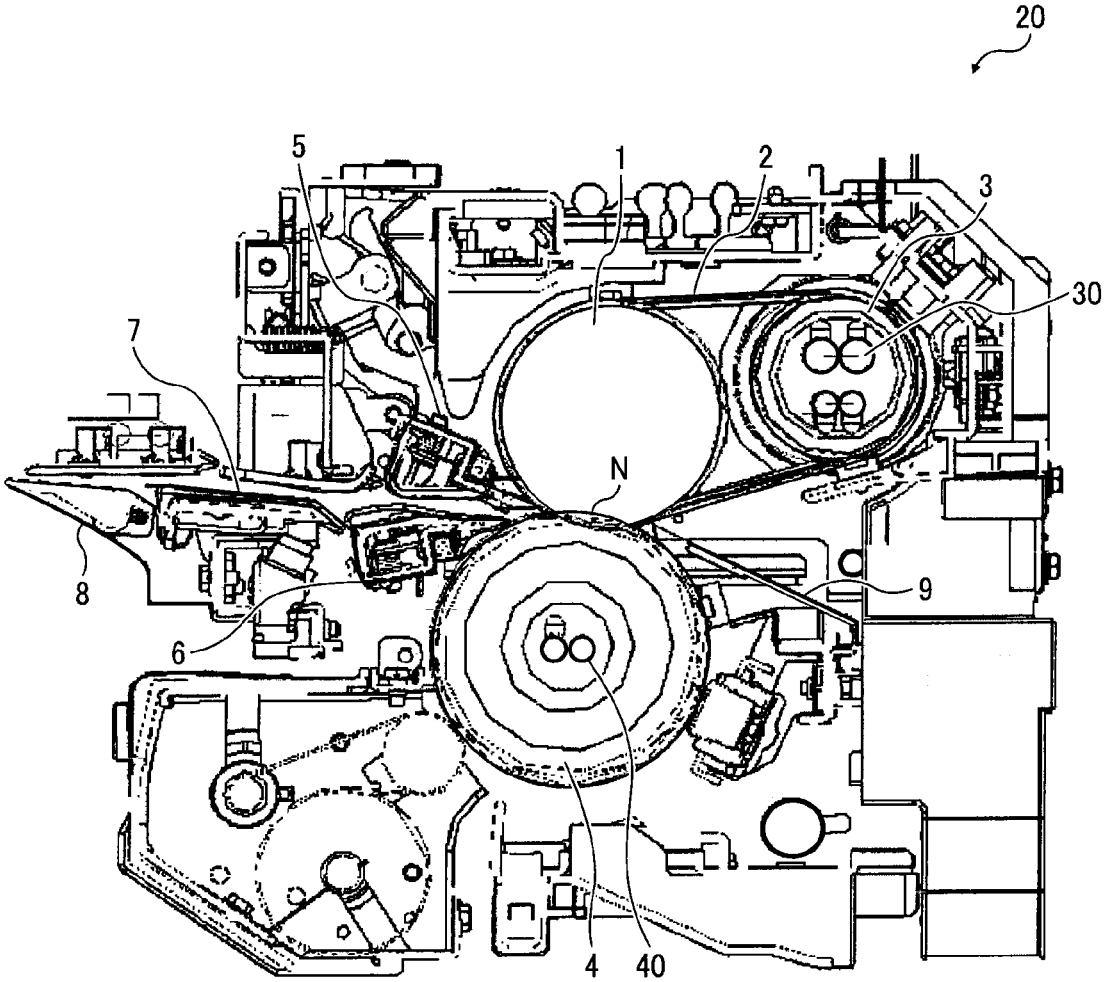
FIG. 1 is a schematic cross-sectional diagram illustrating a fixing device according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially with reference to FIG. 1, a description is provided of a fixing device according to an illustrative embodiment of the present invention.

FIG. 1 is a schematic cross-sectional diagram illustrating a fixing device 20 according to an illustrative embodiment of the present invention. As illustrated in FIG. 1, the fixing device 20 includes a fixing roller 1, a heating roller 3, a fixing belt 2, a pressing roller 4, a separation plate assembly 5, a separation plate assembly 6, and so forth. The fixing belt 2 is wound around the fixing roller 1 and the heating roller 3, and stretched at a predetermined tension. The surface of the fixing belt 2 is heated by a heater 30 disposed inside the heating roller 3. The pressing roller 4 is disposed opposite the fixing roller 1 via the fixing belt 2. The pressing roller 4 rotates and presses against the fixing roller 1, thereby forming a fixing nip N. The separation plate assembly 5 is disposed near the fixing belt 2 at a nip exit of the fixing nip N from which the recording medium is discharged, to prevent the recording medium from winding around the fixing belt 2. The separation plate assembly 6 is disposed near the pressing roller 4 at a nip exit from which the recording medium is discharged, to prevent the recording medium from winding around the pressing roller 4.

The fixing belt 2 is formed into an endless loop having an internal diameter of approximately 80 mm. The fixing belt 2 has a multi-layer structure including a base layer formed of polyimide (PI) having a thickness of approximately 90 μm, for example. A silicone rubber layer having a thickness of approximately 200 μm is provided on the base layer. The silicone rubber layer is coated with tetrafluoroethylene-perfluoroalkylvinylether copolymer (hereinafter PFA) having a thickness of approximately 20 μm as an outermost surface.

The fixing roller 1 includes a heat-resistant elastic layer formed of, for example, silicone rubber foam having an outer diameter of approximately 54 mm and a thickness of approximately 15 mm. The heating roller 3 is constructed of a metal hollow tube, for example, an aluminum tube, having an outer diameter of approximately 40 mm and a thickness of approximately 1 mm. The heating roller 3 includes the heater 30 inside thereof.

The pressing roller 4 is constructed of a metal hollow core including metal material such as copper having a thickness of approximately 1 mm and an outer diameter of approximately 65 mm. On the metal core, a silicone rubber layer having a thickness of approximately 1.5 mm is provided. On the silicone rubber layer, a tube made of perfluoroalkoxy polymer resin (PFA) is provided as an outermost surface. The pressing roller 4 includes a heater 40 inside thereof. The pressing roller 4 is pressed against the fixing roller 1 via the fixing belt 2 at a certain pressure by a pressing mechanism, not illustrated, thereby forming the fixing nip N. According to the illustrative embodiment, the pressing roller 4 sinks into the fixing roller 1 via the fixing belt 2 by approximately 4 mm and forms the fixing nip N having the width of approximately 16 mm.

When the fixing device 20 is activated, the pressing roller 4 rotates in a counterclockwise direction by a driving device, not illustrated, while the pressing roller 4 presses against the fixing belt 2, thereby enabling the fixing belt 2, the fixing roller 1, and the heating roller 3 to rotate. The fixing belt 2 is rotated in the direction in which the recording medium is discharged, that is, a clockwise direction in FIG. 1. During the fixing operation, the fixing belt 2 is heated at an appropriate temperature for fixing toner by the heater 30 of the heating roller 3.

According to the illustrative embodiment, a description of a belt-type fixing member is provided. However, the fixing member is not limited to this. A roller-type fixing member constructed of a hollow tube may be employed. According to the illustrative embodiment, a rotary member herein refers to a fixing member (the fixing belt 2 (a fixing roller)), and a pressing member including the pressure roller 4.

Figure 2:
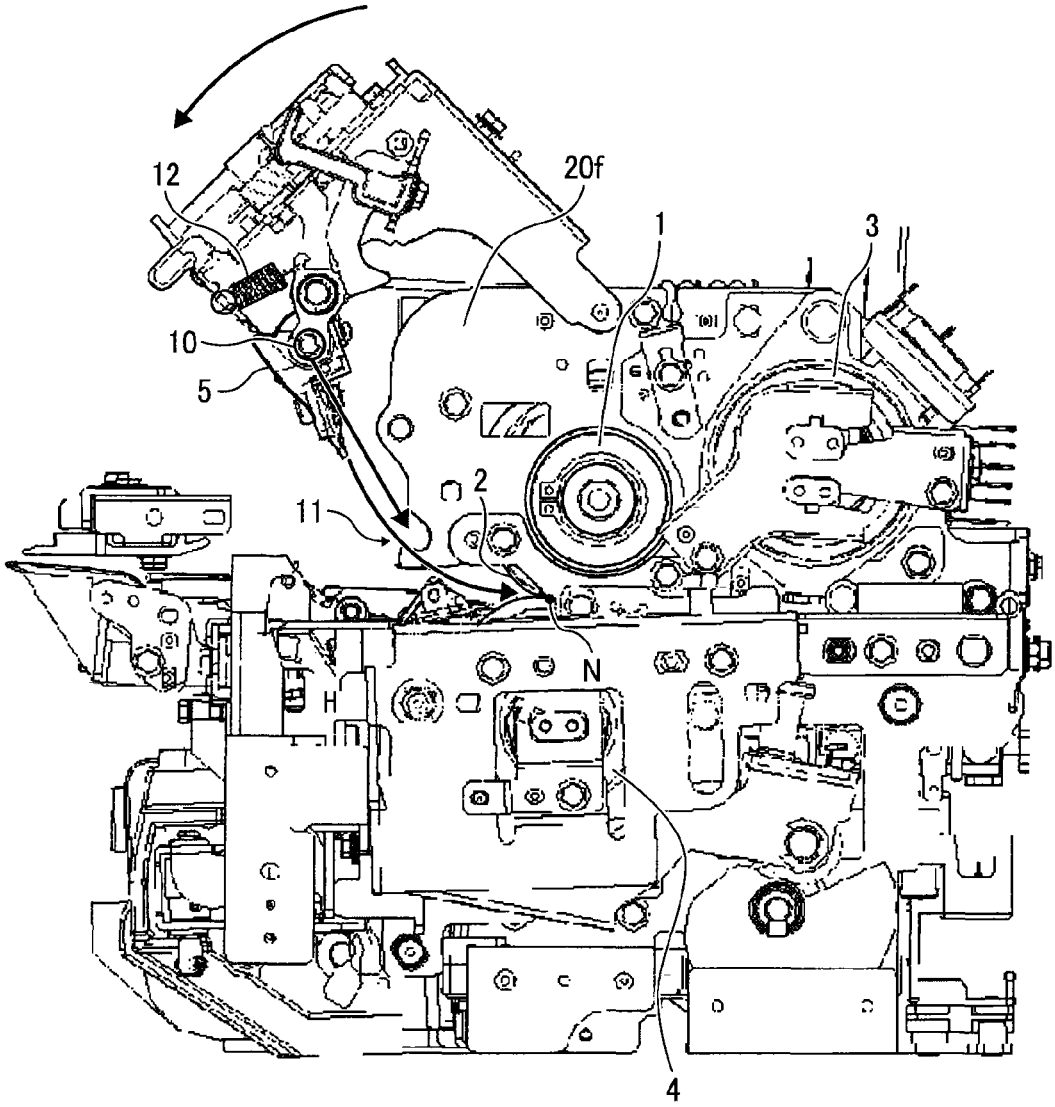
FIG. 2 is a schematic side view of the fixing device of FIG. 1.

With reference to FIGS. 1 and 2, a description is provided of the separation plate assembly 5 according to an illustrative embodiment of the present invention. FIG. 2 is a schematic side view of the fixing device 20. As illustrated in FIGS. 1 and 2, the separation plate assembly 5 is disposed at the nip exit of the fixing nip N at the fixing belt side to separate the recording medium from the fixing belt 2.

As illustrated in FIG. 2, the separation plate assembly 5 can move away from the nip exit, thereby exposing the nip exit to facilitate removal of the recording medium when paper jams occur. When mounting the separation plate assembly 5 at the nip exit of the fixing nip N, a rotation shaft 10 of the separation plate assembly 5 fits a shaft bearing groove 11 provided to a side plate 20*f* that holds the fixing roller 1. Separation members (a separation plate and a contact member) of the separation plate assembly 5 are rotatable about the rotation shaft 10, and a tension spring 12 acts on the separation plate and the contact member to rotate about the rotation shaft 10 toward the fixing belt 2. The contact member of the separation plate assembly 5 is pressed against the fixing roller 1 via the fixing belt 2. The leading edge of the separation plate is positioned facing the fixing belt 2 with a minute gap therebetween.

Figure 3:
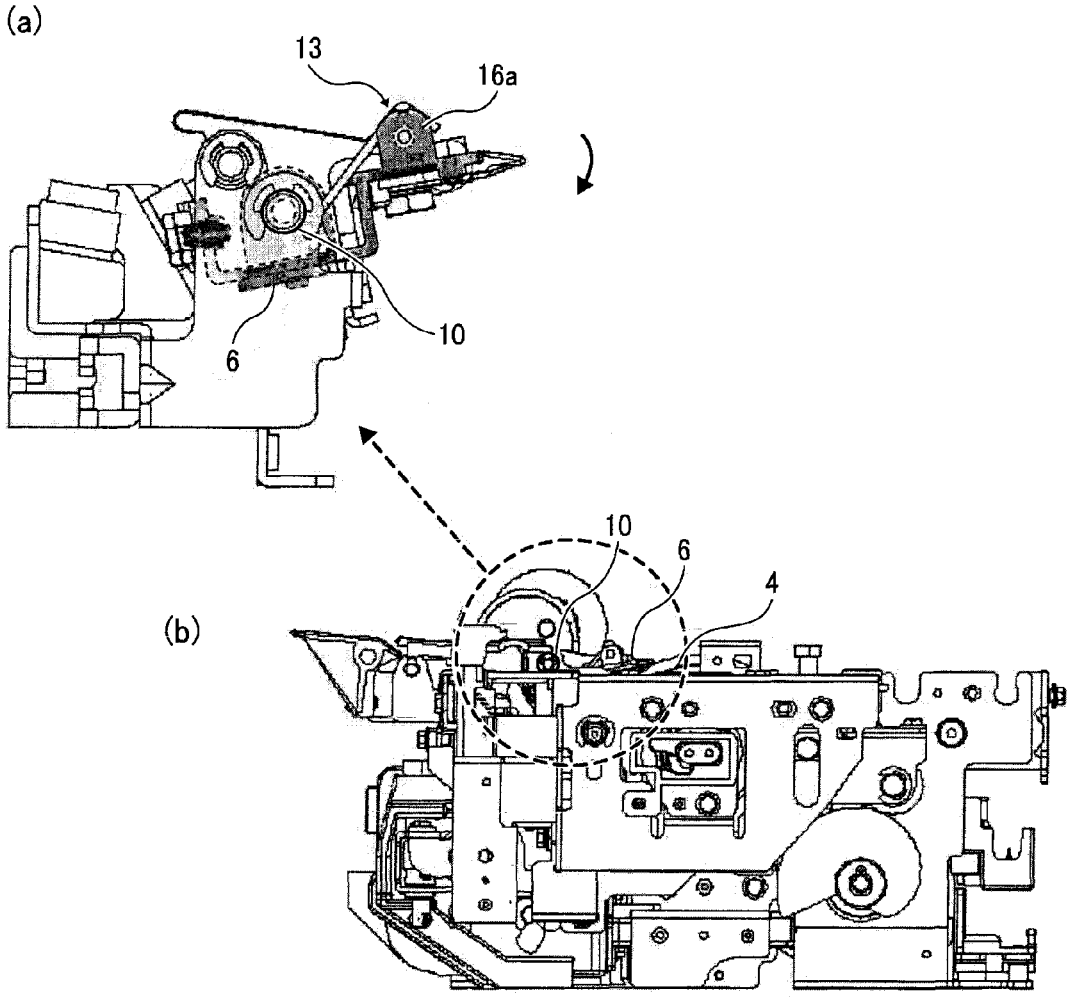
FIGS. 3 (*a*) and 3 (*b*) are schematic side views of a pressing roller and its surrounding structure in the fixing device.

As illustrated in FIGS. 1 through 3, the separation plate assembly 6 is disposed at the nip exit of the fixing nip N at the pressing roller side to separate the recording medium from the pressing roller 4.

FIGS. 3 (*a*) and 3 (*b*) are schematic side views of the pressing roller 4 and its surrounding structure in the fixing device 20. For simplicity, the upper structure including the fixing roller 1 is not illustrated in FIGS. 3 (*a*) and 3 (*b*).

As illustrated in FIG. 3 (*a*), the separation plate assembly 6 is fixed to a pressing roller unit including the pressing roller 4 so that the separation assembly 6 and the pressing roller unit constitute an integrated unit. Accordingly, the separation plate assembly 6 moves together with the pressing roller 4 when the pressing roller 4 presses against or separates from the fixing roller 1.

Similar to the separation plate assembly 5, separation members (a separation plate and a contact member) of the separation plate assembly 6 are rotatable about the rotation shaft 10. A torsion spring 13 acts on a bearing member 16*a* disposed closer to the separation members than the rotation shaft 10 (FIG. 3 (*b*)). Accordingly, the separation members rotate about the rotation shaft 10 towards the pressing roller 4, and the contact member of the separation plate assembly 6 is pressed against the pressing roller 4. The leading edge of the separation plate is positioned facing the pressing roller 4 with a minute gap therebetween.

Referring back to FIG. 1, in the fixing device 20, the fixing belt 2 and the pressing roller 4 meet and press against each other, thereby defining the fixing nip N. While rotating, the surface of the fixing belt 2 is heated at a predetermined temperature. As the recording medium bearing an unfixed toner image is guided to the fixing nip N by a guide 9 and passes through the nip N, heat and pressure is applied to the unfixed toner image, thereby melting and fixing the toner image onto the recording medium. Subsequently, the recording medium on which the toner image is fixed is discharged from the fixing nip N. However, the recording medium may be wound undesirably around the fixing belt 2. In such a case, the leading edge of the separation plate of the separation plate assembly 5 contacts the leading edge of the recording medium, thereby separating the recording medium from the fixing belt 2.

If the recording medium is discharged from the fixing nip, winding undesirably around the pressing roller 4, the separation plate of separation plate assembly 6 contacts the leading edge of the recording medium, thereby separating the recording medium from the pressing roller 4. The recording medium discharged from the fixing nip N is guided outside the fixing device 20 by a bottom guide unit 7 and a sheet guide unit 8.

As will be described later, the image forming apparatus of the present invention includes a duplex printing mechanism. For duplex printing, a first surface of the recording medium on which an image has been fixed contacts the pressing roller 4 in the fixing device 20 when a toner image on a second surface is fixed. If the separation member contacts the pressing roller 4 as in the conventional fixing device, the separation member damages the surface of the pressing roller 4, thereby yielding a resulting image with undesirable patterns or streaks. In view of this, the separation plate of the separation plate assembly 6 should not contact the pressing roller 4 to prevent the pressing roller 4 from getting damaged.

The pressing roller 4 is formed of relatively stiff material (at least stiff enough to sink into the fixing roller when forming the fixing nip N). Therefore, even when the contact member of the separation plate assembly 6 is pressed against the pressing roller 4, the contact member does not sink into the pressing roller 4. When the spring force of the torsion spring 13 biases a pair of contact members at each end of the separation plate assembly 6 in the axial direction against the pressing roller 4, the contact pressure of the pair of contact members may differ from one another, resulting in irregular pressure across the pressing roller 4. In other words, one of the contact members presses the pressing roller 4 harder than the other, thereby damaging the pressing roller 4. Furthermore, the minute gap between the leading edge of the separation plate and the pressing roller 4 cannot be secured so that the recording medium does not separate from the pressing roller properly.

The present inventor found out that the difference in the pressure of the pair of contact members was caused by deformation or twisting of the separation plate assembly 6 due to variations in dimensional and assembly accuracy of parts.

Figure 4A:
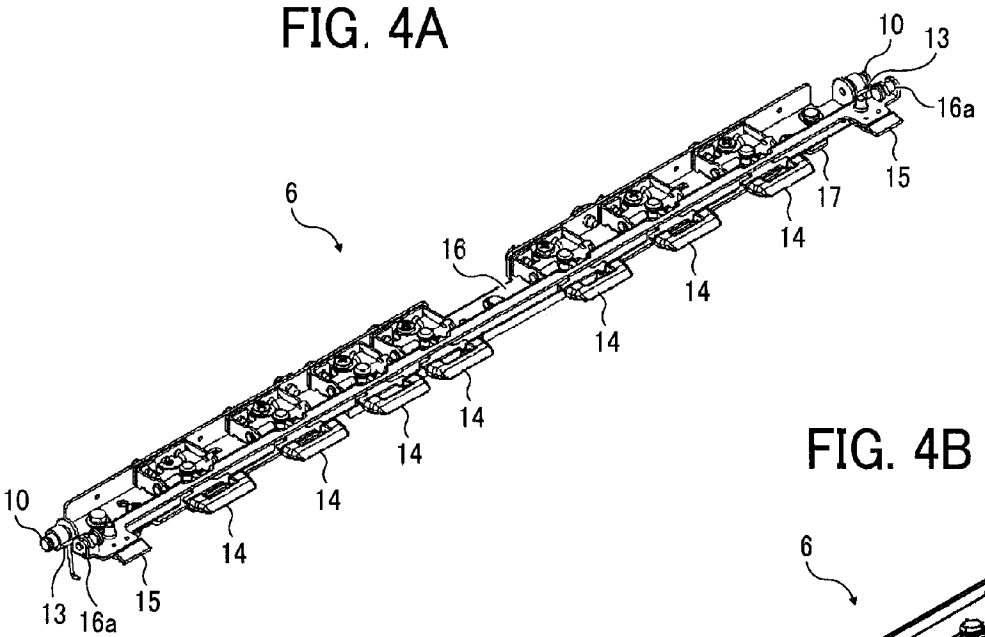
FIG. 4A is a schematic perspective view of a separation plate assembly as viewed from a recording medium transport path.
Figure 4B:
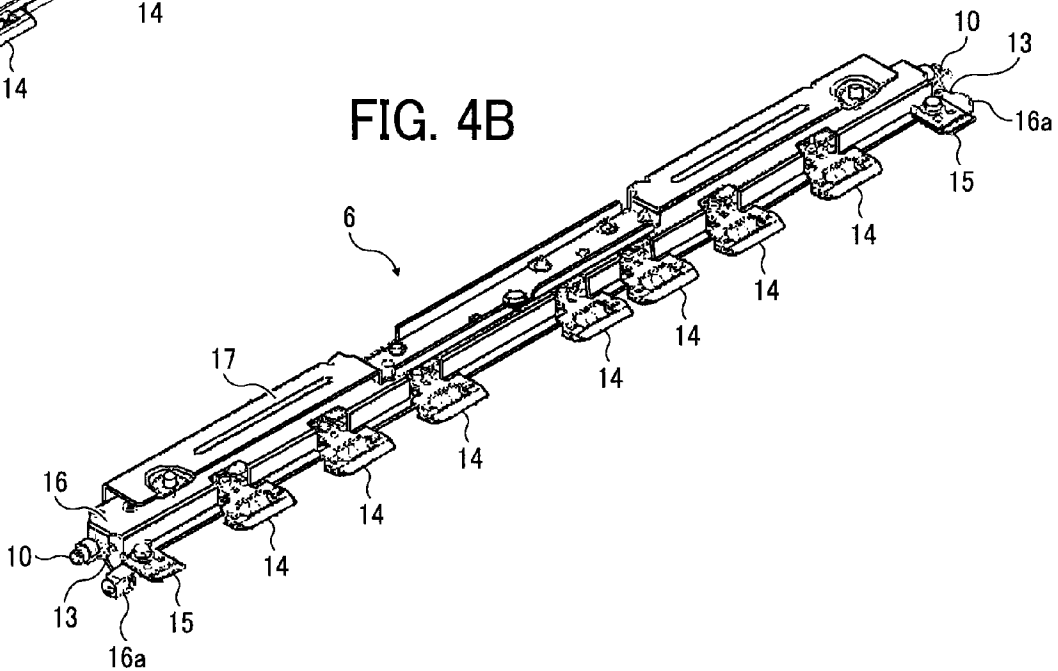
FIG. 4B is a schematic perspective view of the separation plate assembly as viewed from a pressing roller side.

With reference to FIGS. 4A and 4B, a description is provided of the separation plate assembly 6 according to an illustrative embodiment of the present invention. FIG. 4A is a schematic perspective view of the separation plate assembly 6 as viewed from a recording medium transport path. FIG. 4B is a schematic perspective view of the separation plate assembly 6 as viewed from the pressing roller side. In FIGS. 4A and 4B, a longitudinal direction of the separation plate assembly 6 corresponds to the axial direction of the pressing roller 4.

As illustrated in FIGS. 4A and 4B, the separation plate assembly 6 includes at least one separation plate 14, a pair of contact members 15, the rotation shaft 10, the bearing member 16*a*, and a holding member 16 (also called a stay). The rotation shaft 10 is disposed at both ends of the separation plate assembly 6 in the longitudinal direction thereof. The bearing member 16*a* is also disposed at both ends of the separation plate assembly 6. The pair of contact members 15 and one or a plurality of separation plates 14 are aligned in the axial direction of the rotation shaft 10, that is, the longitudinal direction of the separation plate assembly 6, and are held by the holding member 16. The separation plate assembly 6 is disposed at the pressing roller side such that the rotation shaft 10 of the holding member 16 is parallel to the shaft of the pressing roller 4. According to the illustrative embodiment, seven separation plates 14 are provided. However, the number of separation plates 14 is not limited to seven.

The separation plates 14 and the pair of contact members 15 serve as separation members. As illustrated in FIG. 4B, the holding member 16 includes a reference member 17.

It is preferable that the separation plate 14 have sufficient strength so that the separation plate 14 does not get deformed when the recording medium is discharged and comes into contact with the separation plate 14. In the meantime, preferably, the separation plate 14 is soft enough so that the separation plate 14 does not damage the surface of the pressing roller 4 in the case in which the tip of the separation plate 14 contacts the surface of the pressing roller 4. Preferably, the separation plate 14 is made of material having good releasability with respect to toner. For example, the separation plate 14 is a molded member composed of a hard base material and a tip made of fluorocarbon resin softer than the base material. Preferably, the base material and the tip portion are molded together through an insert molding process. The separation plate 14 includes a gap adjuster to adjust a minute gap between the tip of the separation plate 14 and the surface of the pressing roller 4.

The leading edge of the contact member 15 has a curvature radius of R=0.5 mm and serves as a positioning member. The contact member 15 is disposed at both ends of the holding member 16 outside the maximum image area. The elastic force of the torsion spring 13 acts on the pair of contact members 15 so that the contact members 15 contact the surface of the pressing roller 4 at a predetermined pressure. With this configuration, the separation plate 14 does not contact the pressing roller 4 at the nip exit of the fixing nip N.

The separation plate assembly 6 includes the separation members, that is, the separation plate 14 and the pair of contact members 15, rotatably fixed to the fixing roller unit about the rotation shaft 10 as described above. The elastic force of the torsion spring 13 acts on the bearing member 16*a* disposed closer to the separation member side than to the rotation shaft 10, thereby enabling the separation members (the separation plate 14 and the pair of contact members 15) to rotate about the rotation shaft 10 towards the pressing roller 4. Accordingly, the pair of contact members 15 is pressed against the pressing roller 4, and a minute gap is maintained reliably between the leading edge of the separation plate 14 and the pressing roller 4.

The separation plate assembly 6 includes a contact pressure adjuster to adjust the pressure of the pair of contact members 15 pressing against the pressing roller 4 by bending near and a portion of the holding member 16 holding the pair of contact members 15 to the pressing roller side and to the opposite the pressing roller 4. The reference member 17 and an adjusting screw 18 serving as a gap adjuster constitute the contact pressure adjuster. According to the illustrative embodiment, the contact pressure adjuster is provided to correspond to each of the pair of contact members 15 of the holding member 16.

The contact pressure adjuster includes the reference member 17 and the adjusting screw 18 (gap adjuster). The reference member 17 is fixed to the holding member 16 with a certain gap between the reference member 17 and the portion of the holding member 16 holding the contact members 15 as well as a bending portion of the holding member 16 near the portion of the holding member 16 holding the contact members 15. The adjusting screw 18 adjusts locally the size of a gap between the holding member 16 and the reference member 17 at an arbitrary position of the bending portion of the holding member 16 at the contact member side across an axis line between the rotation shafts 10.

Figure 5A:
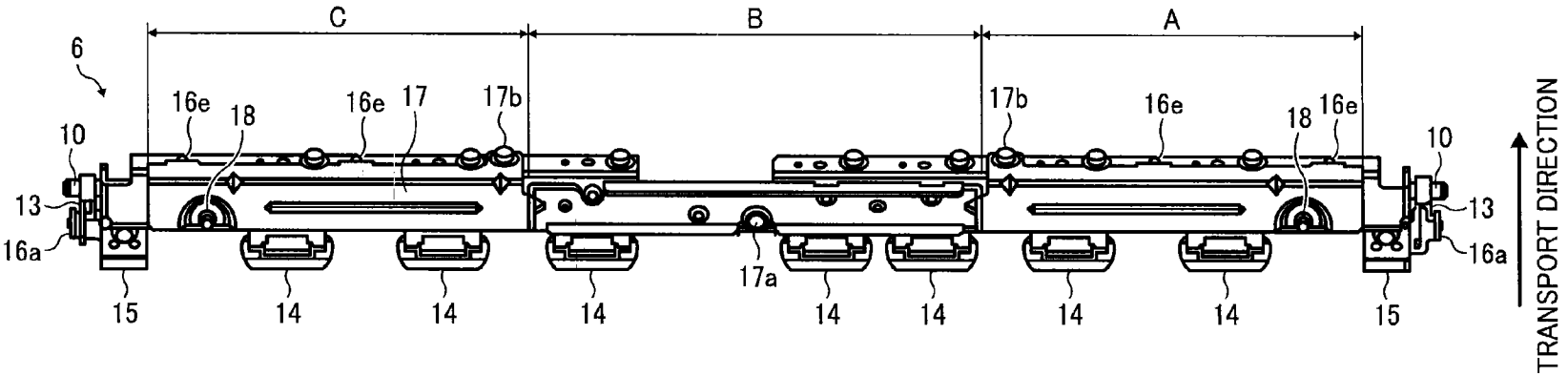
FIG. 5A is a schematic perspective view of the separation plate assembly as viewed from the pressing roller side, according to an illustrative embodiment of the present invention.
Figure 5B:
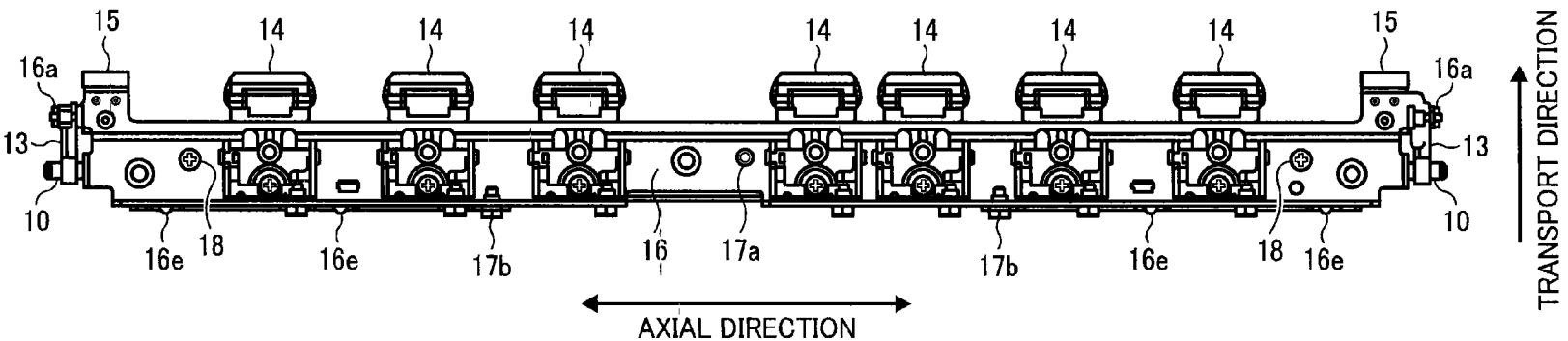
FIG. 5B is a plan view of the separation plate assembly as viewed from the recording medium transport path.
Figure 6:
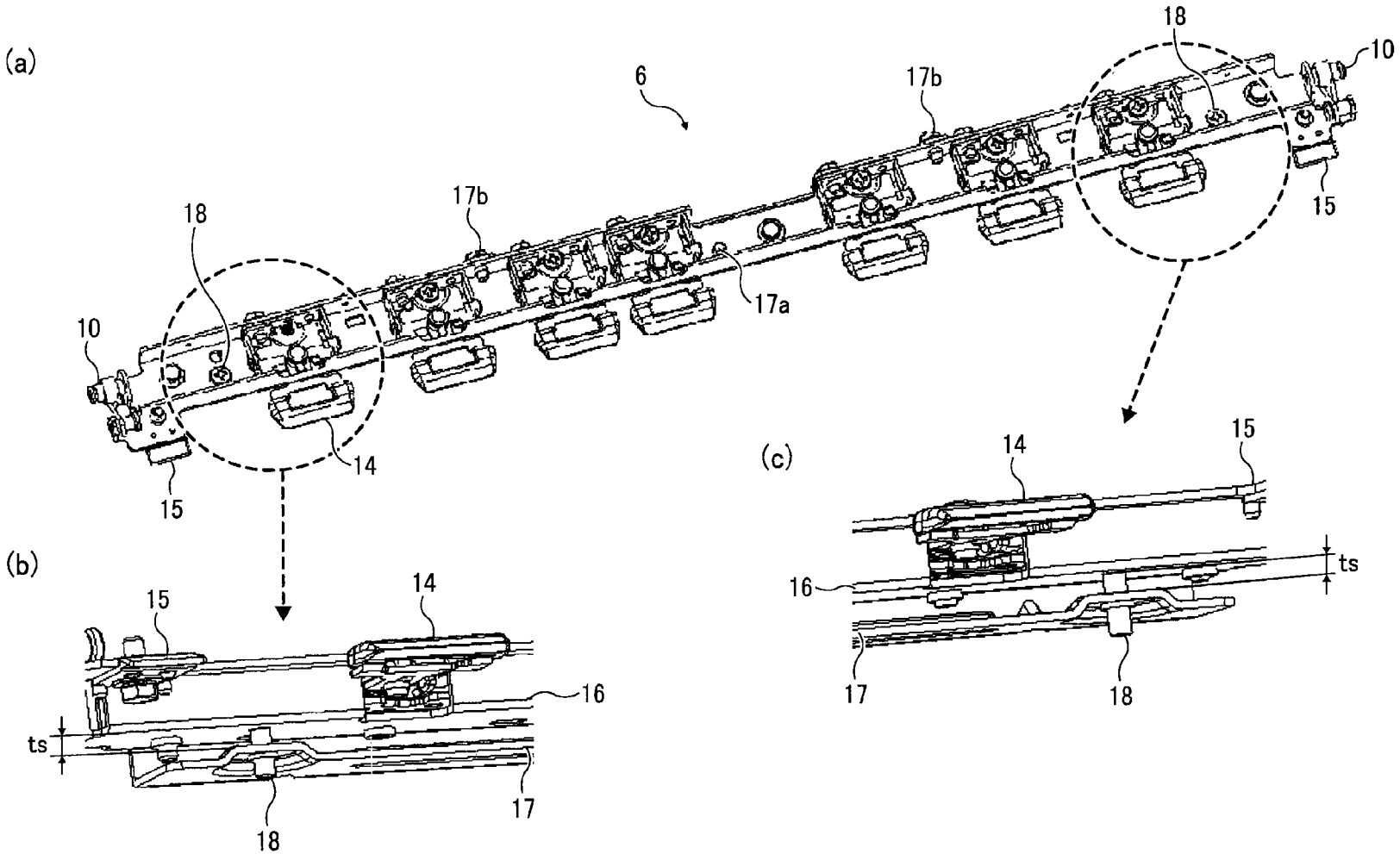
FIG. 6 (*a*) is a schematic diagram illustrating the separation plate assembly, according to an illustrative embodiment of the present invention.
Figure 7:
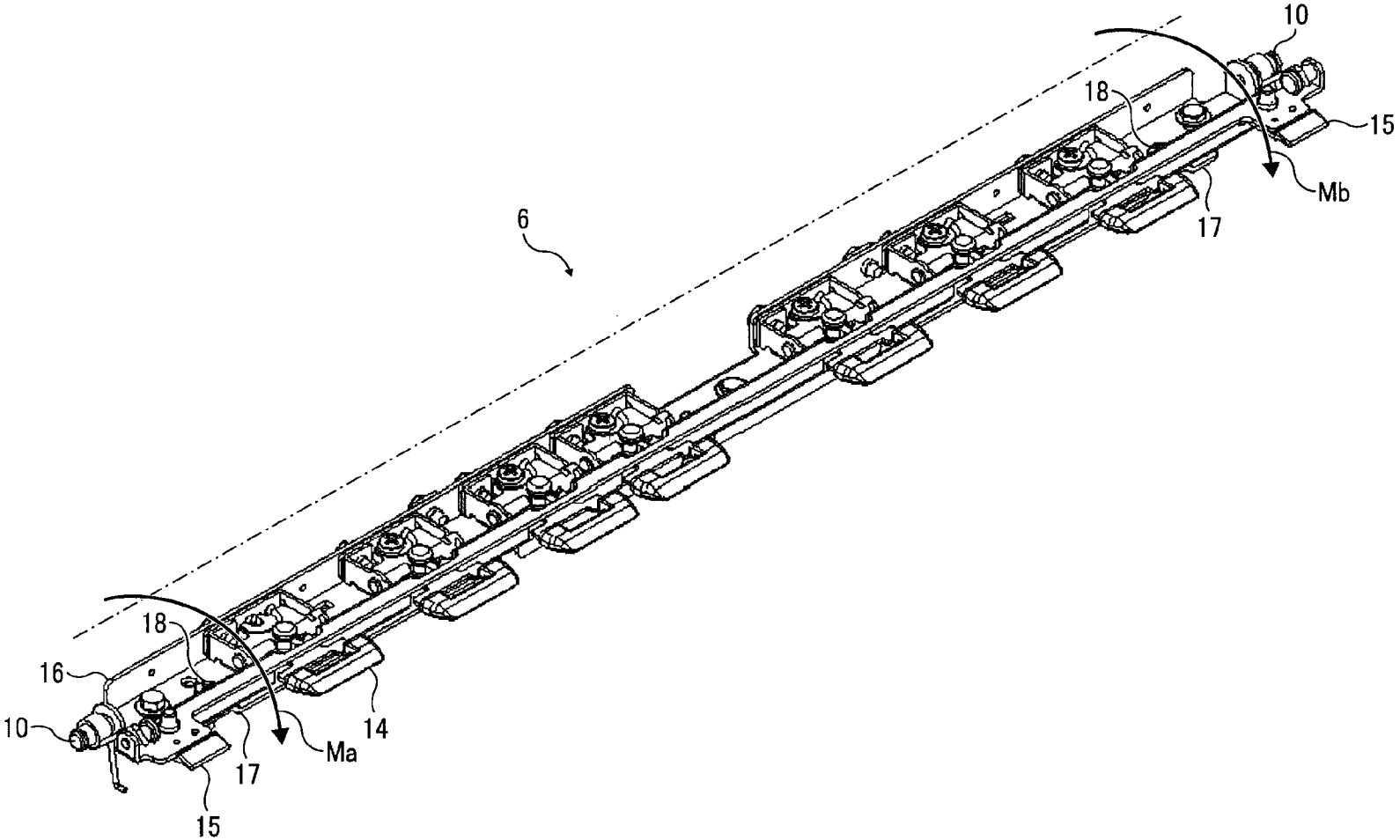
FIG. 7 is a schematic diagram illustrating a contact pressure adjuster of the separation plate assembly, according to an illustrative embodiment of the present invention.

With reference to FIGS. 5 through 7, a description is provided of the contact pressure adjuster. FIG. 5A is a schematic perspective view of the separation plate assembly 6 as viewed from the pressing roller side. FIG. 5B is a plan view of the separation plate assembly 6 as viewed from the recording medium transport path. FIG. 6 (*a*) is a schematic diagram illustrating the separation plate assembly 6. FIGS. 6 (*b*) and 6 (*c*) are partially enlarged perspective views of the contact members 15 and the surrounding structure. FIG. 7 is a schematic diagram illustrating the contact pressure adjuster bending the holding member 16.

The reference member 17 contacts tightly the holding member 16 substantially at the center thereof in the axial direction from the area of the holding member 16 to be bent. The reference member 17 is fixed to the portion of the holding member 16 to be bent across the axis line between the rotation shafts 10 opposite the contact members 15.

As illustrated in FIG. 5A, the reference member 17 is made through metal sheet working such that the surface of the reference member 17 contacts the holding member 16 in an area B substantially at the center in the axial direction. In areas A and C outside the area B in the axial direction, a gap is formed between the reference member 17 and the holding member 16. In the area B, the reference member 17 is fixed to the holding member 16 by the screw 17*a* near the center of the area B. In the areas A and C, the reference member 17 is fixed to the holding member 16 by the screw 17*b* at the downstream side in the direction of transport of the recording medium.

As illustrated in FIGS. 5 and 6, the adjusting screw 18 fastens the reference member 17 to the holding member 16 with a certain gap (ts) in the areas A and C where the holding member 16 is bent. By adjusting a fastening amount of the adjusting screw 18, an amount of bending of the holding member 16 is adjusted, that is, an amount of the gap (ts) is adjusted. More specifically, at the upstream side of the reference member 17 in the recording medium conveyance direction in the areas A and C, the adjusting screw 18 penetrates through a through-hole in the holding member 16 with the gap therebetween. By fastening the adjusting screw 18, a biasing force acts on both the holding member 16 and the reference member 17 such that the amount of gap (ts) between the holding member 16 and the reference member 17 decreases. As a result, the holding member 16 having a stiffness less than that of the reference member 17 bends as an elastic member. For this reason, preferably, the adjusting screw 18 is disposed substantially near the pair of contact members 15.

When the adjusting screw 18 is fastened, thereby generating a biasing force between the holding member 16 and the reference member 17, the ends of the reference member 17 in the axial direction on which the biasing force acts may bend slightly about the screw 17*b*, rotating towards the holding member 16.

In view of the above, as illustrated in FIGS. 5A and 5B, projections (embossed portions) 16*e* are provided to the holding member 16 corresponding to the areas A and C. The projections 16*e* prevent such bending of the reference member 17. More specifically, the projections 16*e* contact the end surface of the reference member 17 to stop the reference member 17 from bending. Accordingly, the contact pressure adjuster can adjust reliably and accurately the contact pressure of the pair of contact members 15.

It is to be noted that, preferably, the reference member 17 has a stiffness greater than that of the holding member 16. The reference member 17 and the holding member 16 are manufactured through metal sheet processing. Preferably, the thickness of the metal sheet constituting the reference member 17 is thicker than that of the holding member 16. For example, the thickness of the sheet for the holding member 16 is approximately 1.2 mm. The thickness of the sheet for the reference member 17 is approximately 1.6 mm.

With this configuration, the stiffness of the reference member 17 is greater than the holding member 16. When fastening the adjusting screw 18, the holding member 16 bends without deforming the reference member 17 serving as a reference, thereby adjusting the amount of bending of the holding member 16 efficiently by fastening the adjusting screw 18.

As described above, because the holding member 16 and the reference member 17 are fastened by the screw at the center (the area B) in the axial direction, when fastening the adjustment screw 18 on the left in FIG. 7, a moment Ma acts on the left end portion (the area A) of the holding member 16. As a result, the upstream side of the holding member 16 in the direction of transport of the recording medium at the left end portion fine area A) bends towards the reference member 17. In other words, the contact member 15 at the left side in FIG. 7 twists towards the pressing roller 4.

By contrast, when fastening the adjustment screw 18 at the right side in FIG. 7, a moment Mb acts on the right end portion (the area C) of the holding member 16. As a result, the upstream side of the holding member 16 in the direction of transport of the recording medium at the right end portion (the area C) bends towards the reference member 17. In other words, the contact member 15 at the right side in FIG. 7 twists towards the pressing roller 4. The amount of bending or twist of the holding member 16 can be adjusted by adjusting the fastening amount of one of the adjustment screws 18 at the left and the right portions or both.

According to the illustrative embodiment, the amount of bending of the holding member 16 by the contact pressure adjuster is adjusted such that each of the contact members 15 presses the pressing roller 4 at the same pressure.

Figure 8:
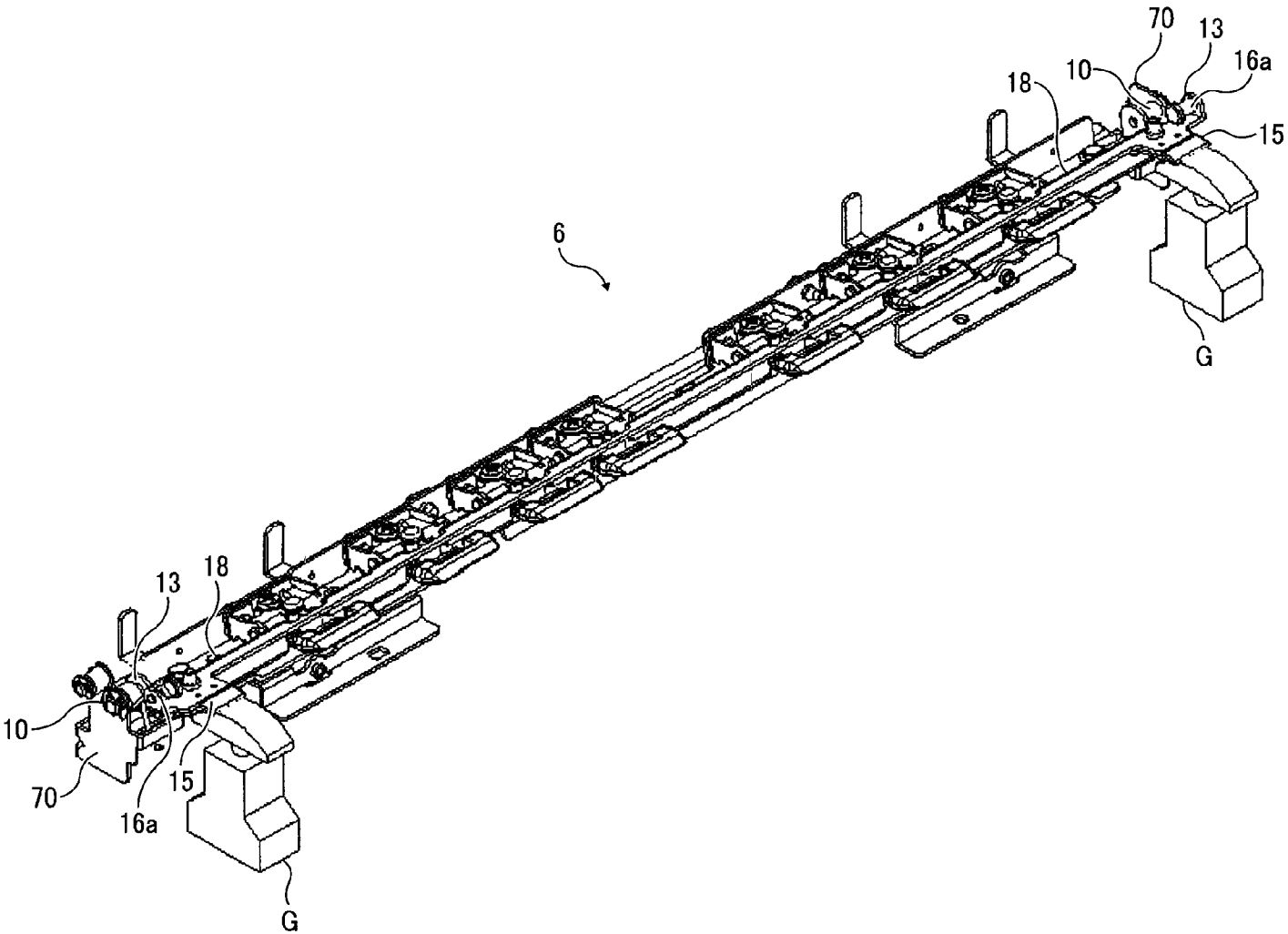
FIG. 8 is a schematic diagram illustrating the separation plate assembly and a measuring device to measure a contact pressure of the contact pressure adjuster.

Next, with reference to FIG. 8, a description is provided of an example of adjustment of the contact pressure of the contact members 15 of the separation plate assembly 6 relative to the pressing roller 4 by using the contact pressure adjuster. FIG. 8 is a schematic diagram illustrating the separation plate assembly 6 and a digital force gage for measuring the contact pressure of the pair of contact members 15.

The digital force gage is disposed under each of the contact members 15. The rotation shaft 10 at each end of the separation plate assembly 6 is supported by supporting jigs 70 in the same matter as when the separation plate assembly 6 is fixed to the roller unit of the pressing roller 4. The elastic force of the torsion spring 13 acts on the bearing 16*a*, thereby rotating the separation plate assembly 6 about the rotation shafts 10 and pressing the pair of contact members 15 against the digital force gages.

The amount of fastening of one of the adjustment screws 18 or both is adjusted while observing the value of the digital force gages at both ends. According to the illustrative embodiment, the adjustment screws 18 are adjusted such that the same values are obtained by the digital force gages. For example, if the value of the digital force gage at the right side is higher than the digital force gage at the left side, that is, the pressure at the right side is higher than the left side, the adjustment screw 18 at the left side is fastened. After adjusting the adjustment screws 18, the separation plate assembly 6 is mounted in the pressing roller unit of the pressing roller 4.

As described above, the contact pressure of the contact members 15 is adjusted by the contact pressure adjuster using a measuring device such as the digital force gage during assembly. Accordingly, the amount of bending of holding member 16 in the areas A and C is adjusted to cancel out deformation or twist of the separation plate assembly 6 as a whole while maintaining parallelism of the axis line of the rotation shafts 10 relative to the shaft of the pressing roller 4. With this configuration, the same contact pressure can be obtained for the pair of contact members 15 relative to the pressing roller 4 with accuracy, thereby preventing damage on the pressing roller 4. The minute gap between the pressing roller 4 and the leading edge of the separation plates 14 disposed between the pair of contact members 15 is maintained accurately, thereby separating the recording medium from the pressing roller 4 reliably.

Figure 9:
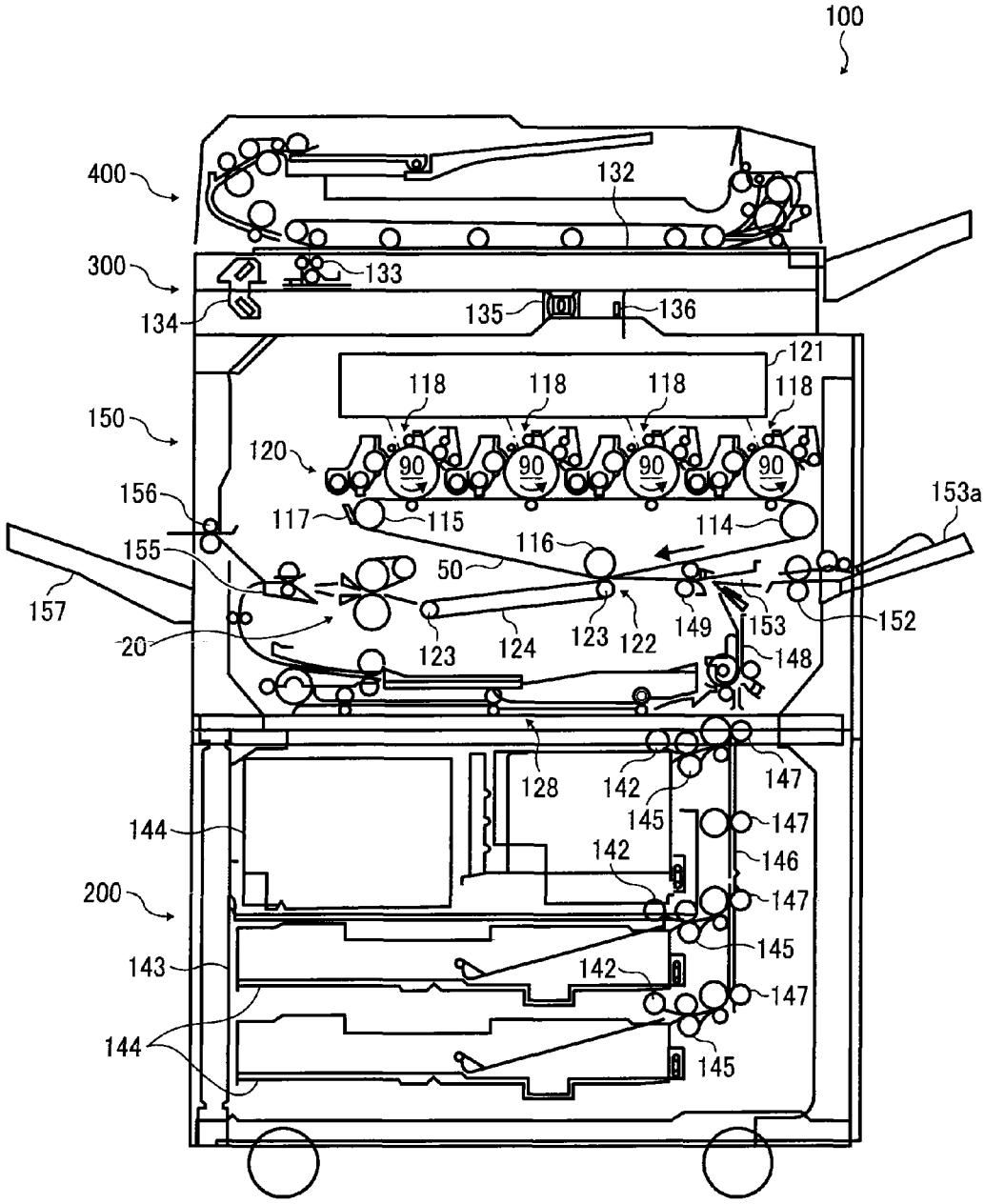
FIG. 9 is a schematic cross-sectional diagram illustrating an image forming apparatus according to an illustrative embodiment of the present invention.

With reference to FIG. 9, a description is provided of an image forming apparatus according to an illustrative embodiment of the present invention. FIG. 9 is a schematic cross-sectional diagram illustrating an image forming apparatus employing the fixing device 20 according to an illustrative embodiment of the present invention.

An image forming apparatus 100 is a tandem-type color image forming apparatus equipped with a copier 150, a sheet feeding unit 200, a scanner 300, and an automatic document feeder (hereinafter ADF) 400.

The copier 150 includes a looped intermediate transfer belt 50 disposed substantially in the center of the copier 150. The intermediate transfer belt 50 is wound around support rollers 114, 115, and 116, and is rotated in a clockwise direction. A cleaning device 117 is disposed in the vicinity of the support roller 115 to remove residual toner remaining on the intermediate transfer belt 50 after a transfer process.

The image forming apparatus 100 includes an image forming unit 120 including four image forming stations 118, each forming a respective one of a plurality of images of the colors yellow, cyan, magenta, and black. In the image forming unit 120, the image forming stations 118 are arranged facing the intermediate transfer belt 50 wound around the support rollers 114 and 115 in the transport direction of the recording medium. It is to be noted that the image forming stations 118 all have the same configuration as all the others, differing only in the color of toner employed.

An exposure device 121 is disposed substantially above the image forming unit 120. A secondary transfer device 122 is disposed opposite the exposure device 121 via the intermediate transfer belt 50. In the secondary transfer device 122, a secondary transfer belt 124 formed into a loop is wound around a pair of support rollers 123. The recording medium transported on the secondary transfer belt 124 can contact the intermediate transfer belt 50.

As illustrated in FIG. 9, the fixing device 20 of the present invention is disposed downstream from the secondary transfer device 122 in the direction of transport of the recording medium. A reversing unit 128 is disposed downstream from the fixing device 20 to turn over the recording medium so that an image is formed on both sides of the recording medium.

Next, a description is provided of forming a multicolor image forming operation using the image forming unit 120.

First, an original document is placed on a document table of the automatic document feeder 400 or on a contact glass 132 of the scanner 300 by opening the ADF 400. When the original document is placed on the contact glass 132, the ADF 400 is closed. When pressing a start button, not illustrated, of the image forming apparatus 100, the original document in the ADF 400 is conveyed to the contact glass 132.

When directly placing the original document on the contact glass 132, the scanner 300 is driven immediately, enabling a first carriage 133 and a second carriage 134 of the scanner 300 to scan the original document. A light source of the first carriage 133 projects light against the document surface, and then the light reflected by the document surface is reflected by a mirror of the second carriage 134. Subsequently, the light is received by a read sensor 136 through an imaging lens 135, thereby reading the document image as image information of black, yellow, magenta, and cyan. The image information of yellow, cyan, magenta, and back is transmitted to the respective image forming stations 118, thereby forming a visible images, also known as toner images, of yellow, cyan, magenta, and black.

Each of the image forming stations 118 includes a photoconductive drum 90 serving as an image bearing member, a charging device, a developing device, a transfer charging device, a cleaning device, and a charge neutralizer. The charging device charges uniformly the photoconductive drum 90. Based on the image information, the exposure device 121 exposes the charged photoconductive drums, thereby forming an electrostatic latent images on the photoconductive drums 90. Subsequently, the electrostatic latent images on the photoconductive drums are developed with the respective colors of toner and are transferred onto the intermediate transfer belt 50 using the transfer charging device while the intermediate transfer belt 50 rotates so that they are superimposed one atop the other, forming a composite toner image. After the transfer process, the cleaning device removes the residual toner remaining on the intermediate transfer belt 50, and the charge neutralizer neutralizes the charge remaining on the intermediate transfer belt 50 in preparation for the subsequent imaging cycle.

The sheet feeding unit 200 includes a paper bank 143 equipped with multiple sheet cassettes 144, each provided with a sheet feed roller 142. In the sheet feeding unit 200, one of sheet feed rollers 142 is rotated selectively to pick up a top sheet of the recording media sheet in the sheet cassette 144 and send it to a separation roller 145 that feeds the recording medium to a sheet feed path 146 one sheet at a time. The recording medium is transported to a sheet feed path 148 of the copier 150 by a transport roller 147 and contacts a pair of the registration rollers 149. The recording medium is stopped temporarily by the registration rollers 149. In a case in which the recording medium is fed manually, a separation roller 152 is rotated to feed the recording medium placed on a manual feed tray 153*a* to a manual feed path 153. The recording medium is stopped temporarily by the registration rollers 149.

Generally, the registration rollers 149 are connected to ground. Alternatively, however, in order to remove paper dust and the like, the registration rollers 49 may be electrically biased.

Subsequently, the registration rollers 149 are rotated again and thus the recording medium is sent to the secondary transfer nip in appropriate timing such that the recording medium is aligned with the composite color toner image formed on the intermediate transfer belt 50. The recording medium is sent between the intermediate transfer belt 50 and the secondary transfer device 122 so that the composite toner image is secondarily transferred onto the recording medium, forming a color image on the recording medium. After the toner image is transferred, the residual toner remaining on the intermediate transfer belt 50 is cleaned by a cleaning device 117. The recording medium on which the color image is formed is transported from the secondary transfer device 122 to the fixing device 20. In the fixing device 20, heat and pressure are applied to the color image on the recording medium, thereby fixing the image on the recording medium.

Subsequently, a switching claw 155 changes the direction of transport of the recording medium to a discharge roller 156 which discharges the recording medium onto a sheet discharge tray 157. Alternatively, the switching claw 155 may guide the recording medium to the reversing unit 128 in which the recording medium is turned over so that an image is formed on the other side of the recording medium. After the image is formed, the recording medium is discharged by the discharge roller 156 onto the sheet discharge tray 157.

According to the illustrative embodiment, the image forming apparatus is equipped with the fixing device 20, thereby preventing paper jams in the fixing nip N and hence enabling reliable image forming operation for an extended period of time.

Figure 10A:
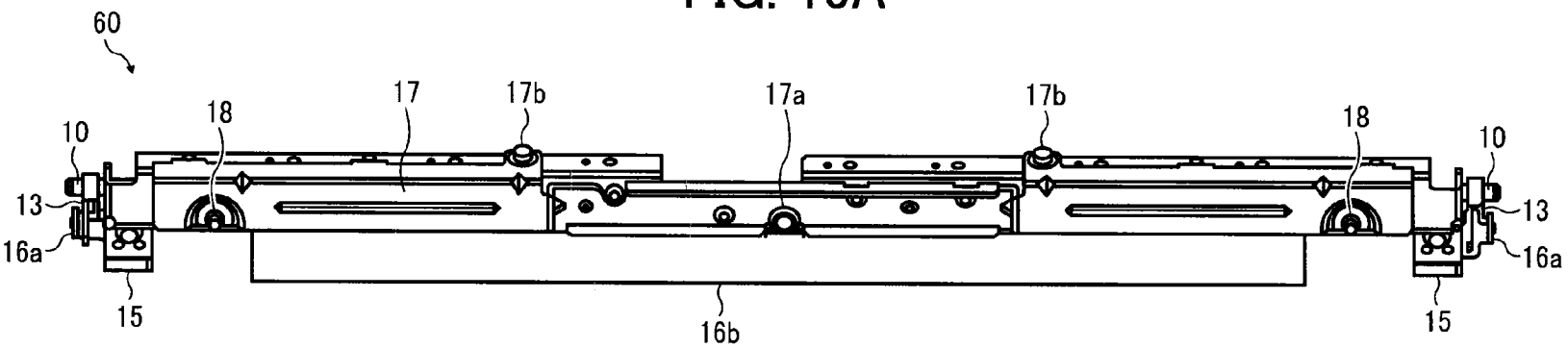
FIGS. 10A and 10B are schematic diagrams illustrating a separation plate assembly according to another illustrative embodiment of the present invention.
Figure 10B:
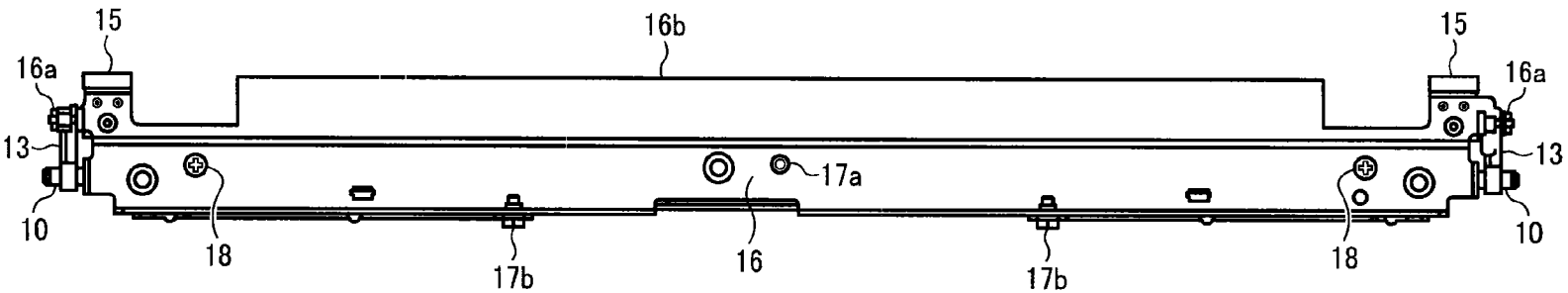

The foregoing description pertains to the fixing device 20 having the separation plate assembly 6 employing the plurality of separation plates 14. Alternatively, as illustrated in FIGS. 10A and 10B, a separation plate assembly 60 may employ a single separation plate 16*b*. FIGS. 10A and 10B are schematic diagrams illustrating the separation plate assembly 60 according to another illustrative embodiment. It is to be noted that the same reference numerals used in the foregoing embodiment are given to constituent elements such as parts and materials having the same functions, and the descriptions thereof will be omitted.

As illustrated in FIGS. 10A and 10B, the separation plate assembly 60 includes one separation plate 16*b*, the pair of contact members 15, the rotation shafts 10, and the holder 16. The holder 16 holds the separation plate 16*b* and the pair of contact members 15 arranged in the axial direction of the rotation shafts 10 (longitudinal direction of the separation plate assembly). In the fixing device 20, the separation plate assembly 60 is disposed at the pressing roller side such that the rotation shafts 10 of the separation plate assembly 60 is substantially parallel to the shaft of the pressing roller 4. The separation plate assembly 60 includes the contact pressure adjuster that adjusts the contact pressure of the pair of contact members 15 against the pressing roller 4 by bending near and one of the portions of the holding member 16 holding the contact members 15 towards the pressing roller side or to the opposite of the pressing roller 4. The separation plate 16*b* and the holding member 16 are constituted as a single integrated member.

In the separation unit 60, the contact pressure adjuster includes the reference member 17 and the adjusting screw 18 (gap adjuster). The reference member 17 is fixed to the holding member 16 with a certain gap between the reference member 17 and the portion of the holding member 16 holding the contact members 15 as well as a bending portion of the holding member 16 near the portion of the holding member 16 holding the contact members 15. The adjusting screw 18 adjusts locally the size of a gap between the holding member 16 and the reference member 17 at an arbitrary position of the bending portion of the holding member 16 at the contact member side across the axis line between the rotation shafts 10.

As described above, the contact pressure of the contact members 15 relative to the pressing roller 4 is adjusted by the contact pressure adjuster. Accordingly, the amount of bending of holding member 16 in the areas A and C is adjusted accurately, offsetting deformation or twist of the separation plate assembly 60 as a whole while maintaining parallelism of the axis line of the rotation shafts 10 relative to the shaft of the pressing roller 4. With this configuration, the same contact pressure can be obtained accurately for the pair of contact members 15 relative to the pressing roller 4, thereby preventing the pressing roller 4 from getting damaged.

The foregoing description pertains to the adjusting screws 18 to reduce the gap (ts) between the holding member 16 and the reference member 17 in the separation plate assemblies 6 and 60. Alternatively, the adjusting screws 18 may increase the gap (ts) between the holding member 16 and the reference member 17.

The separation units 6 and 60 may be disposed at the fixing member side such as the fixing belt 2 or the fixing roller if the roller-type fixing member is employed.

As described above, the contact pressure of the contact members 15 relative to the fixing member is adjusted by the contact pressure adjuster. Accordingly, the amount of bending of the holding member 16 in the areas A and C is adjusted accurately offsetting deformation or twist of the separation plate assembly 6 (60) as a whole while maintaining parallelism of the axis line of the rotation shafts 10 relative to the shaft of the fixing member. With this configuration, the same contact pressure can be obtained for the pair of contact members 15 relative to the fixing member with accuracy, thereby preventing the fixing member from getting damaged.

The minute gap between the pair of pressing rollers 15 and the leading edge of the separation plates 14 disposed between the pair of contact members 15 is maintained accurately, thereby separating reliably the recording medium from the fixing member.

The present invention can be applied to a roller or a belt employed in a fixing device, a developing device, a cleaning device, or the like that requires adjustment of a gap relative to the roller.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device, comprising:

two rollers to meet and press against each other to form a fixing nip; and a separation plate assembly disposed near one of the rollers, the separation plate assembly including at least one separation plate to separate a recording medium exiting the fixing nip from the roller;

a pair of contact members disposed outside a maximum image area;

a holding member having a rotation shaft at each end in a longitudinal direction thereof, to hold at least one separation plate and the pair of contact members along an axial direction of the rotation shafts parallel to a rotation shaft of the roller; and a contact pressure adjuster to adjust a contact pressure of the pair of contact members relative to the roller by bending a portion of the holding member holding one of the pair of contact members to the roller and to the opposite of the roller, wherein when the holding member is rotated about the rotation shafts, the pair of contact members contacts the roller to separate the tip of at least one separation plate from the roller.

2. The fixing device according to claim 1, wherein the contact pressure adjuster comprises a reference member fixed to the holding member with a predetermined gap between the bending portion of the holding member and the reference member, and a gap adjuster to adjust the gap locally at an arbitrary position of the bending portion of the holding member across an axis line between the rotation shafts of the holding member at the contact member side to bend the holding member based on the reference member.

3. The fixing device according to claim 2, wherein the reference member is fixed to the holding member across the axis line between the pair of the rotation shafts of the holding member opposite the contact members and contacts tightly the holding member substantially at the center thereof in the axial direction from the bending portion of the holding member.

4. The fixing device according to claim 2, wherein the gap adjuster is a screw to fasten the holding member and the reference member with the gap between the bending portion of the holding member and the reference member, and an amount of bending of the holding member is adjusted by fastening the screw.

5. The fixing device according to claim 2, wherein the reference member is made of material shaving stiffness greater than the holding member.

6. The fixing device according to claim 2, wherein the reference member and the holding member are manufactured through metal sheet processing, and the sheet of the reference member is thicker than that of the holding member.

7. The fixing device according to claim 1, wherein the amount of bending of the holding member by the contact pressure adjuster is adjusted such that each of the contact members presses against the roller at the same pressure.

8. The fixing device according to claim 1, wherein the pressure adjuster is provided to correspond to each of the contact members.

9. An image forming apparatus, comprising:

an image bearing member to bear an electrostatic latent image on a surface thereof;

a developing device to develop the electrostatic latent image formed on the image bearing member using toner to form a toner image;

a transfer device configured to transfer the toner image onto the recording medium; and the fixing device of claim 1.

* * * * *